United States Patent [19]

Wineburner et al.

[11] 4,088,305

[45] May 9, 1978

[54] BRAKE-ONE WAY WINCH

[75] Inventors: Ronald E. Wineburner, Pekin; Norman R. Allen, Washington, both of Ill.

[73] Assignee: Caterpillar Tractor Co., Peoria, Ill.

[21] Appl. No.: 751,562

[22] Filed: Dec. 17, 1976

[51] Int. Cl.[2] ..... B66D 1/00

[52] U.S. Cl. ..... 254/187.5; 254/150 FH; 192/12 B

[58] Field of Search ..... 254/150 R, 150 FH, 187.1, 254/187.4, 187.5, 187.8; 188/291, 71.2; 192/12 B, 12 BA

[56] References Cited

U.S. PATENT DOCUMENTS

| | | | |
|---|---|---|---|
| 2,023,679 | 12/1935 | Galkin | 192/12 B X |
| 2,407,811 | 9/1946 | Brundage | 254/187.8 |
| 2,567,526 | 9/1951 | Nitkey | 254/187.5 |
| 3,685,621 | 8/1972 | Gulick et al. | 192/12 B |
| 4,004,779 | 1/1977 | Flesburg | 254/187.4 |

*Primary Examiner*—Drayton E. Hoffman
*Assistant Examiner*—Donald W. Underwood
*Attorney, Agent, or Firm*—Phillips, Moore, Weissenberger, Lempio & Majestic

[57] ABSTRACT

The invention is concerned with an improvement in a winch and fluid control system. The preferred system which is improved comprises (1) a rotatable drum for receiving and releasing a cable (2) a drive train for supporting the drum and for selectively transmitting rotary drive thereto, said drive train including a brake. A source of pressurized fluid, forms another part of said system. Said system further comprises a control valve having an inlet communicating with said source of pressurized fluid, and having an outlet system and a valving element which is shiftable between at least three positions including a Brake-On position, a Reel-In position and a Brake-Off position. The improvement of the present invention comprises a normally engaged one-way clutch intermediate said brake and a stationary support therefor which always allows substantially unrestricted rotation of said drive train relative to said stationary support in a Reel-In direction and normally prevents rotation of said drive train relative to said stationary support in a Reel-Out direction; and means for selectively disengaging said brake to allow substantially unrestricted rotation of said drive train in said Reel-Out direction.

7 Claims, 8 Drawing Figures

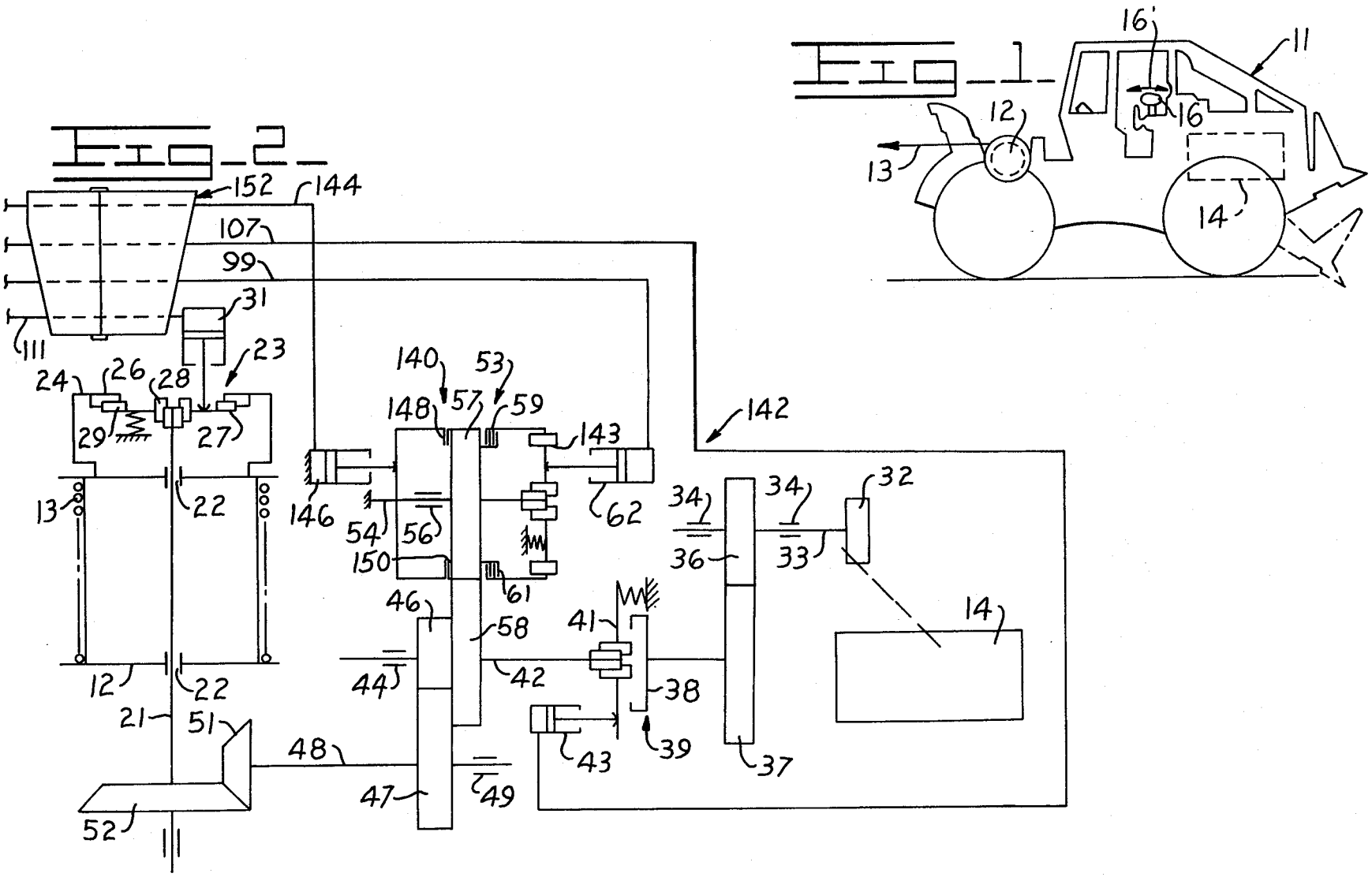
11
14
16
16'
12
13
14
32
33
34
34
36
37
142
38
39
41
43
62
143
59
53
57
61
58
42
49
140
148
56
46
44
47
54
150
146
48
144
152
107
99
31
23
27
28
26
29
24
22
22
51
21
12
13
52
111

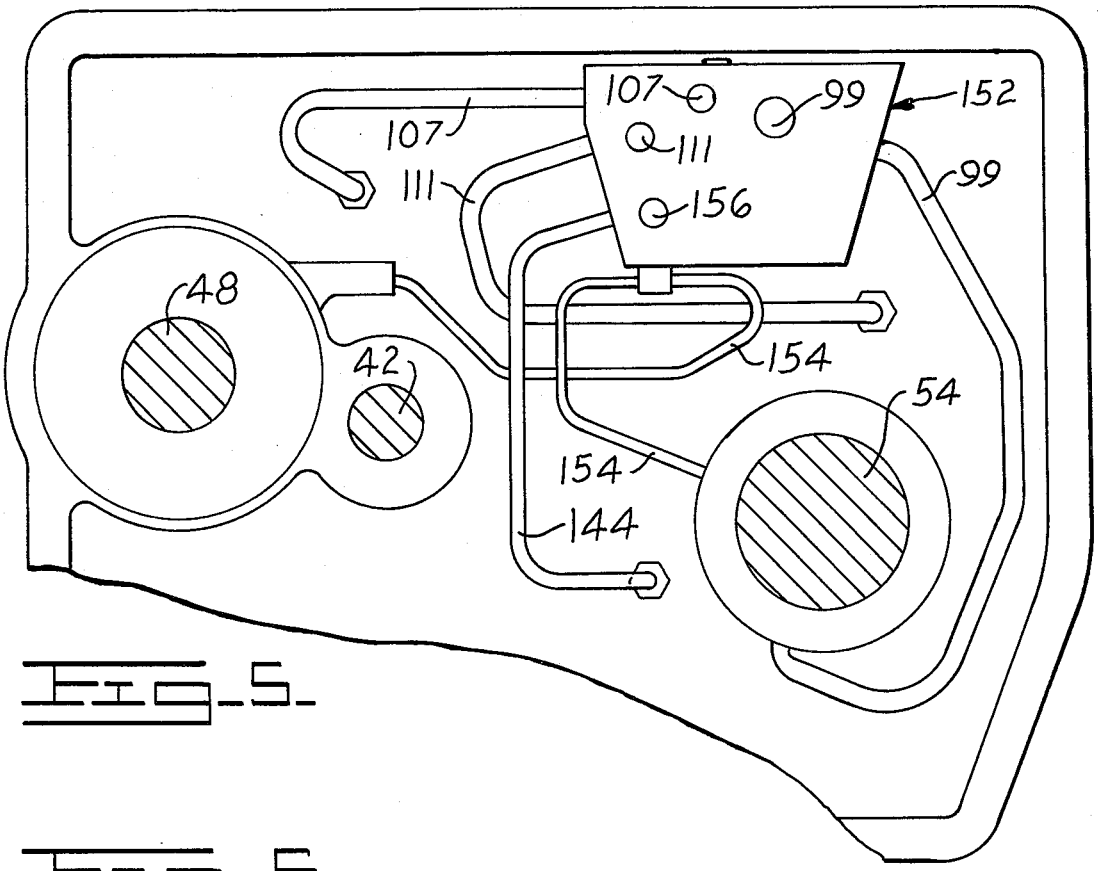
Fig. 5.
Fig. 6.
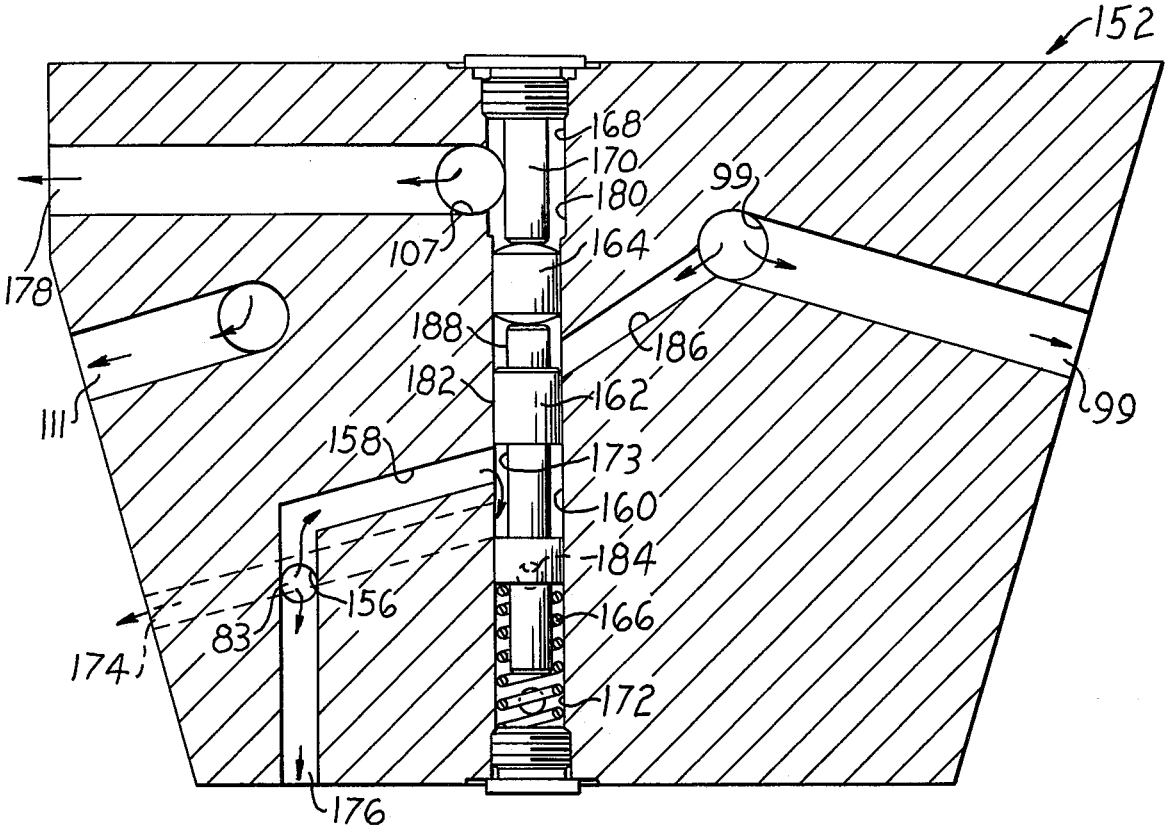

BRAKE-ONE WAY WINCH

BACKGROUND OF THE INVENTION

1. Field of the Invention

This invention relates to winches having a powered rotatable drum for winding in and releasing a cable or the like and more particularly to a winch system of the type in which the drum is driven and controlled by means of fluid pressure-operated clutches and brakes.

2. Prior Art

Prior application Ser. No. 334,354 of L. F. Yates et al, filed Feb. 21, 1973 for "WINCH WITH FREE-WHEELING DRUM" now abandoned and co-pending application Ser. No. 662,320 of L. F. Yates et al, filed Mar. 1, 1976 for "WINCH WITH FREE-WHEELING DRUM" as a continuation-in-part of application Ser. No. 334,354, both assigned to the assignee of the present application, disclose a winch assembly which is driven by an engine through a drive train having a normally disengaged input clutch which engages in response to fluid pressure to enter a Reel-In mode where it reels in cable. The drive train also includes a normally engaged brake for immobilizing the winch drum and providing a Brake-On mode but which releases in response to fluid pressure in other modes of operation. In addition to the Brake-On and Reel-In modes of operation, the brake alone may be pressurized to effect a Brake-Off mode in which load forces pulling on the line may unwind cable against the limited resistance created by the drag of the drive train components. This limited resistance prevents excess unwinding of cable caused by a load, by drum momentum, or motivated by other causes, but is sufficiently strong that it is difficult or impossible to withdraw cable manually while such resistance is present. Accordingly, the drive train connects to the winch itself through a disconnect clutch which is normally engaged but which may be disengaged by fluid pressure to allow manual unreeling of cable from the drum without working against a substantial resistance thus providing a Free-Spool (or Disconnect) mode. This form of winch assembly is highly useful on a log skidder vehicle, for example, which is used to drag logs from the site of a lumbering operation and also has substantial advantages in other contexts.

Prior U.S. Pat. No. 3,841,608 discloses a hydraulic control system for a winch assembly of this kind in which a manually operated control valve may be shifted between a series of positions to pressurize and depressurize appropriate ones of the clutches and brake of the drive train in order to accomplish the several operational modes described above. The valve settings include Reel-In, Brake-On, Brake-Off and Free-Spool and are realized by movement of a control lever or the like. For safety reasons as well as for convenience of operation, centering springs urge the control valve towards the Brake-On position so that if the operator releases his control lever or the like, the winch is automatically immobilized.

The operator of these winch systems must pay careful attention to the position of his control lever or the like in order to control movement of a load in a safe and efficient manner. It is particularly important to avoid movement of the lever into the Disconnect position through misjudgment while a load is pulling on the cable to be released, creating unwanted slack, when dropping of the load stops or slows. Diversion of the operator's visual attention in order to guard against this occurrence is undesirable in many cases, particularly in such usages as on a log skidder where the operator must pay attention to controlling the vehicle itself in addition to operating the winch.

U.S. Pat. application Ser. No. 574,807 of Edward E. Flesburg, filed May 5, 1975 for "WINCH AND FLUID CONTROL SYSTEM THEREFOR", commonly assigned herewith, now U.S. Pat. No. 4,004,779 issued Jan. 25, 1977 discloses means which enable the operator of such winch systems to determine when the control lever is approaching the Free-Spool position without necessarily relying on visual observation.

It has been discovered by us that in a winch system, including at least some of the features discussed above, certain advantages are realized by the use of a one-way clutch between the normally engaged brake and a stationary support therefor which disengages the brake from the support when the winch is in the Reel-In mode thus allowing the plates of the brake to rotate freely in the Reel-In mode. Namely, exact sequencing of brake and clutch pressures is not necessary and it is not necessary to release the brake during the Reel-In operation. In short, the brake is allowed to rotate in a Reel-In direction without its being released. Overall, a one-way clutch in accordance with the invention is used so as to prevent fallback of winch cable due to clutch and brake pressures overlapping and due to a suspended load running the converter backwards during low idle operation.

SUMMARY OF THE INVENTION

The present invention provides an improvement in a winch and fluid control system. The system comprises a rotatable drum for receiving and releasing a cable. Drive means support the drum and selectively transmit rotary drive thereto. The drive means includes a brake for stopping rotation of said drive means relative to stationary support means. The system also includes a source of fluid pressure. Control valve means form a part of the system and include inlet means communicating with the fluid pressure source, and an outlet system and valving element means which is shiftable between at least three positions including a Brake-On position, a Reel-In position and a Brake-On position.

The improvement of the present invention comprises normally engaged one-way clutch means intermediate the brake and stationary support means therefor which always allows substantially unrestricted rotation of said drive means relative to said stationary support means in a reel-in direction and normally prevents rotation of said drive means relative to said stationary support means in a reel-out direction along with means intermediate the outlet system and the brake for selectively disengaging the brake to allow substantially unrestricted rotation of the drive means in the reel-out direction.

BRIEF DESCRIPTION OF THE DRAWINGS

The invention will be better understood by reference to the figures of the drawings wherein like numbers denote like parts throughout and wherein:

FIG. 1 illustrates in a side elevational view a log skidder vehicle equipped with a winch system including a one-way disconnect clutch in accordance with the present invention;

FIG. 2 illustrates in a schematic diagram the winch system of FIG. 1 showing the interconnection of drive train and control mechanism elements between the winch drum and the driving engine;

FIG. 3 may be juxtaposed end-to-end with FIG. 2 to form a single figure in which fluid conduit interconnections between the control valve and the winch system are readily apparent;

FIG. 5 illustrates in an end view the structural configuration of fluid flow directing means useful in the present invention;

FIG. 6 illustrates details in structure of the preferred fluid flow directing means shown in FIG. 5;

DETAILED DESCRIPTION OF THE PREFERRED EMBODIMENT

Figure 3:
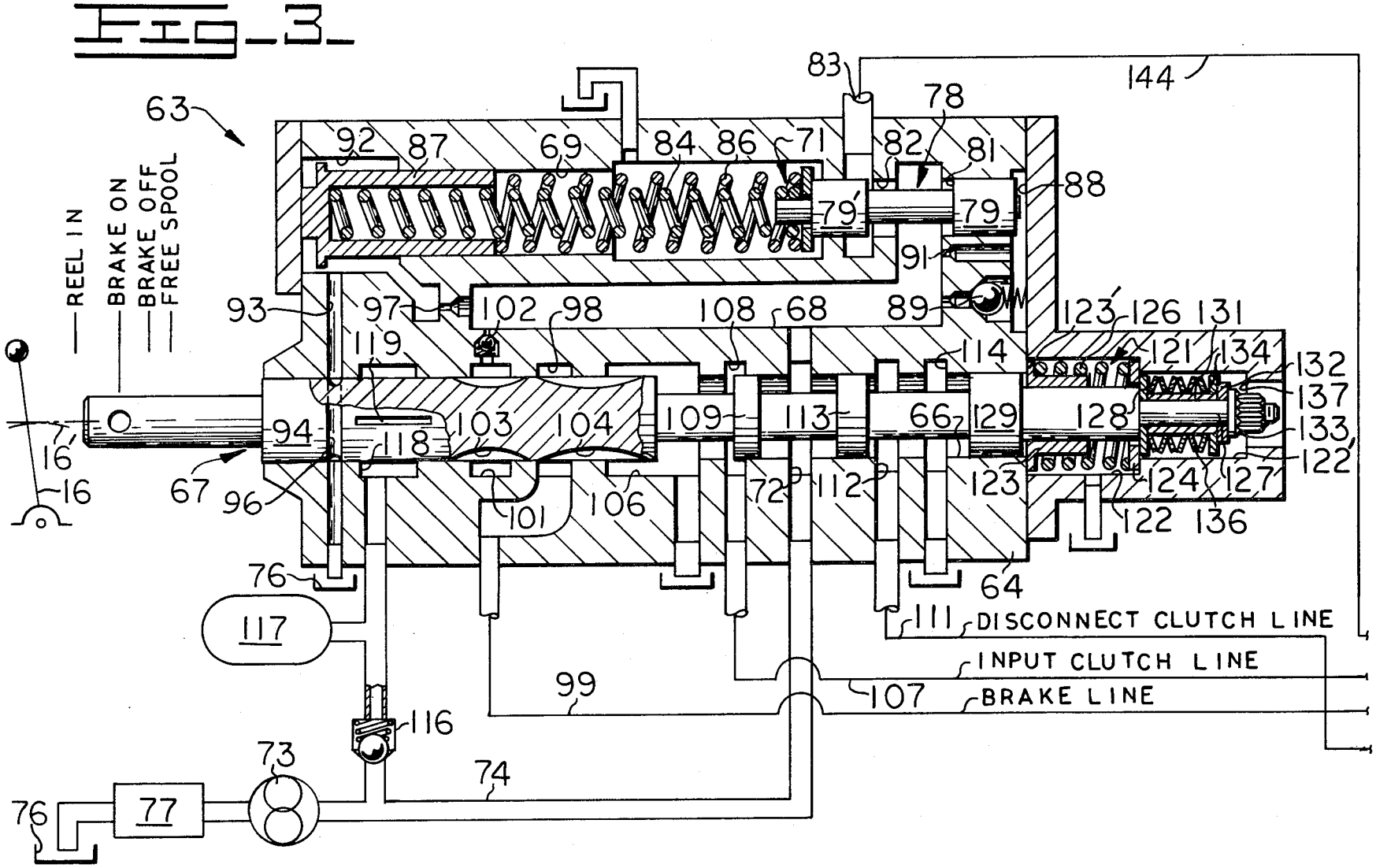
FIG. 3 illustrates in a sectional view a control valve for supplying appropriate fluid pressure to control mechanisms of FIG. 2 in response to movement of an operator's control lever and shows the valve in the Brake-On position at which the winch drum is immobilized.

The winch system of the present invention was initially developed for use on a log skidder vehicle and will therefore be described in that particular context for purposes of example, it being apparent that the apparatus may also be employed on diverse other forms of load-manipulating equipment. Referring initially to FIG. 1, a log skidder vehicle 11 is normally used in lumbering operations primarily for dragging heavy logs away from the site of tree-felling operations. For this purpose, the vehicle is provided with a rotatable winch drum 12 having a length of cable 13 wound thereon.

As is understood by those skilled in the art, it is necessary at times to immobilize the winch drum 12 so that the vehicle may be used to drag a log while at other times cable 13 must be reeled in by driving the drum from a suitable engine such as the vehicle engine 14. At other times it is necessary to release cable from the winch drum 12. If the cable is to be withdrawn from the drum by the weight of the load pulling on the cable, it is desirable that there be some limited resistance to drum rotation. Such resistance prevents overly fast or erratic release of cable and prevents momentum from causing an excess amount of cable to be released when load movement slows or stops. However, there is another cable release mode of operation in which any sizable resistance to rotation of the winch drum 12 is undesirable. This occurs when there is no load fastened to the cable 13 and it is necessary to manually withdraw cable from the drum 12. Under those circumstances, it is desirable that the operator not have to pull against any significant resistance.

The above-identified prior applications Ser. Nos. 334,354 and 662,320 and Prior U.S. Pat. No. 3,841,608 disclose a winch mechanism construction and a hydraulic control system therefor and the present system may be essentially similar and may if desired include the control valve modifications of the above-identified copending application Ser. No. 574,807. In this form of winch system, an operator may manipulate a single control lever 16 to establish any of the above-described modes of winch operation. The control lever 16 is pivotable along an arc 16' and has a centered position which is the Brake-On position at which the winch drum is immobilized. The lever 16 may be pivoted to a Reel-In position and may be pivoted to a Brake-Off position at which cable may be withdrawn by load forces pulling on the cable although substantial resistance to such withdrawal must be overcome for reasons to be hereinafter described. In order to free the winch drum from any significant resistance so that cable may readily be withdrawn manually, the control lever may be shifted through the Brake-Off position to an extreme forward setting which is the Free-Spool position. As will hereinafter be described this provides means which substantially increases the resistance to forward lever movement just prior to entering the Free-Spool position to assure that the operator is aware that the lever is about to go to that position.

Referring now to FIG. 2, the winch drum 12 may be supported on a rotatable drive shaft 21 by bearings 22. Except in the Free-Spool mode of operation, the drum 12 is caused to rotate with the drive shaft by a normally engaged jaw clutch 23. Clutch 23 may be of the known form in which an annular member 24 carrying teeth 26 is coupled to the drum while another member 27 is coupled to drive shaft 21 through splines 28 which enable axial movement relative to the drive shaft. Member 27 carries teeth 29 and is spring-biased to a position at which the teeth 29 engage teeth 26. The jaw clutch 23 may be selectively disengaged by pressurization of a fluid actuator 31 which then forces the member 27 out of engagement with member 24 to disconnect the drum from the drive shaft.

To transmit drive from engine 14 to drum 12 when it is desired to reel in cable, the engine turns a winch system input member 32 which is secured on an input shaft 33 that is in turn supported by bearings 34. Shaft 33 also carries a transfer gear 36 which engages another transfer gear 37 to transmit drive to an input member 38 of a normally disengaged input clutch 39 of the friction disc type. Clutch 39 has one or more output discs 41 which are spline-connected to an output shaft 42 for axial movement thereon and which are spring-biased towards a position at which the disc or discs are free of engagement with input member 38. Input clutch 39 may be selectively engaged by pressurizing a fluid actuator 43 which then urges output disc 41 towards input member 38 to effect engagement.

Shaft 42, supported by another bearing 44, carries a transfer gear 46 which engages another transfer gear 47 secured to a shaft 48 which is supported by still another bearing 49. Drive is transmitted from shaft 48 to the winch drum drive shaft 21 through a bevel gear 51 on shaft 48 which engages another bevel gear 52 on shaft 21.

To provide for immobilizing the winch drum when necessary, a normally engaged brake mechanism 53 is coupled to shaft 42 through a pair of gear means 57 and 58. A stationary shaft 54 carries the gear 57 supported on bearing 56 which engages the gear 58 carried on the shaft 42. The brake mechanism 53 may be of the friction disc type which includes one or more brake discs 59 spline-coupled to brake shaft 54 for axial movement thereon and spring-biased towards a position at which each disc 59 is urged against a brake disc 61. Brake mechanism 53 may be selectively disengaged by pressurization of a fluid actuator 62 which then urges discs 59 away from discs 61.

With all actuators 31, 43 and 62 unpressurized, the system is in the Brake-On mode of operation at which winch drum 12 is immobilized by brake 53 except for reel-in operation as will be explained below. By pressurizing actuator 43, the Reel-In mode is established at which drive is transmitted to drum 12 to reel in cable. Pressurization of actuator 62 is unnecessary as will be explained below. When a load is pulling on the cable 13, cable may be released by pressurizing only actuator 62 to disengage brake 53 and establish the Brake-Off mode. In this mode of operation, there is a limited degree of resistance to release of the cable due to the drag created by the frictional resistance and inertia of the gearing system coupled to the drum through disconnect clutch 23. That resistance is typically sufficiently high that it is very difficult or impossible to manually withdraw cable from the drum when there is no load pulling on the cable. To facilitate such manual withdrawal of cable, actuator 31 may be pressurized to establish the Free-Spool mode at which the drum is uncoupled from drum drive shaft 21 and the other elements of the drive train.

Referring now to FIG. 3, there is shown a control valve 63 through which the clutch and brake actuators 31, 43 and 62 may be selectively pressurized by movement of the operator's control lever 16 to effect any of the above modes of winch operation, the control valve being shown at the Brake-On position at which all actuators are unpressurized. Control valve 63 has a valve body 64 with a bore 66 in which a valving element formed by a spool 67 is disposed. Spool 67 is shiftable along the axis of bore 66 by pivoting of control lever 16.

Valve body 64 has a fluid inlet chamber 68 and an additional bore 69 in which a pressure-modulating relief valve assembly 71 is disposed. A groove 72 in bore 66 is communicated with inlet chamber 68 and receives pressurized fluid from a pump 73 through a conduit 74. Pump 73, which may be driven by the previously described vehicle engine or other means, draws fluid from a sump 76 through a filter 77.

Modulating relief valve assembly 71 functions to establish a fluid pressure in inlet chamber 68 which is normally at a predetermined level sufficient to fully actuate the previously described clutches and brake through the associated actuators but also functions to drop the pressure in inlet chamber 68 to a lower level when the spool 67 is shifted to the Brake-On position and thereafter to produce a controlled rise of the pressure back up to the maximum level following movement of the spool away from the Brake-On position in either direction.

The modulating relief valve assembly may include a spool 78 having a pair of lands 79 and 79' separated by a groove 81, the spool being disposed for axial movement in a reduced-diameter extension 82 of bore 69. Bore extension 82 is communicated with inlet chamber 68 and, in conjunction with an edge of spool land 79', forms a flow metering passage through which fluid from the inlet chamber may be released to a discharge conduit 83 to provide lubricating oil at relatively low pressure, e.g., about 40 psig and regulate system pressure. A pair of coaxial springs 84 and 86 extend within bore 69 between the end of the spool 78 and a load piston 87 at the opposite of the bore 69 to urge the spool to a position at which land 79' blocks the release of fluid from bore extension 82. The force of springs 84 and 86 on spool 78 is opposed by fluid pressure in another chamber 88 which receives fluid from inlet chamber 68 through a check valve 89. Fluid may be gradually released from chamber 88 back into the inlet chamber 68 through a restricted flow orifice 91.

Thus the position of valve spool 78 is determined by the extent to which fluid pressure in chamber 88 acting on the spool is able to overcome the opposed force of springs 84 and 86 on the spool and thereby permit a controlled release of fluid from inlet chamber 68. The springs are selected to establish a predetermined base pressure within the inlet chamber 68 which is low in relation to the pressure required to fully actuate the previously described clutches and brake. Thus, with the load piston 87 fully to the left as viewed in FIG. 3, the fluid pressure within chamber 88 is able to shift spool 78 sufficiently to discharge fluid from inlet chamber 68 at a rate which keeps the inlet chamber pressure at a low value. If load piston 87 is then shifted rightwardly to increase the spring force on valve spool 78, the pressure within the inlet chamber 68 and in chamber 88 must rise to a higher value in order to force the spool 78 to the position at which fluid can continue to be released. Thus system pressure may be raised in a modulated manner by shifting load piston 87 progressively to the right as viewed in FIG. 3.

To control the load piston 87 so that system pressure is minimal at the Brake-On setting of lever 16 and rises in a modulated manner when the lever is moved away from that position in either direction, a chamber 92 behind the load piston at the end of bore 69 is communicated with the tank 76 through a passage 93 which extends across valve spool bore 66. Valve spool 67 has a land 94 which blocks flow through passage 93 at any position of spool 67 other than the Brake-On position. At the Brake-On position, a groove 96 on land 94 enables fluid to discharge from load piston chamber 92 through passage 93.

Load piston chamber 92 receives fluid from inlet chamber 68 through a flow orifice 97. This flow of pressurized fluid into the load piston chamber 92 does not move the load piston 87 when control spool 67 is in the Brake-On position since the load piston chamber is vented at that time through drain passage 93 and spool groove 96. However, if the control spool 67 is shifted away, in either direction, from the Brake-On position, drain passage 93 is blocked. The flow of pressurized fluid through orifice 97 then raises the pressure in chamber 92 causing the load piston 87 to move to the right as seen in FIG. 3 thereby raising the system pressure within inlet chamber 68 as described above. Accordingly, a shift of the control lever 16 in either direction away from the Brake-On position is followed by a rise of system pressure within inlet chamber 68. The pressure then remains at a high level until control spool 67 is again shifted to the Brake-On position at which the pressure behind the load piston 87 is relieved.

Considering now the action of the valving element spool 67 in distributing pressurized fluid to appropriate ones of the clutches and brake at the various positions of the spool, bore 66 has a groove 98 which is communicated with the brake actuator 62 of FIG. 2 through a brake line 99. Referring again to FIG. 3, bore 66 has an additional groove 101 which receives pressurized fluid from inlet chamber 68 through a check valve 102. Spool 67 has a series of flow-metering grooves 103 located to increasingly release pressurized fluid from groove 101 into groove 98 when the control spool is shifted toward the Brake-Off position to pressurize the brake actuator and thereby release the brake. An adjacent set of metering slots 104 on spool 67 communicate groove 98 with an adjacent drain groove 106 when the spool is at the Brake-On position thereby de-pressurizing the brake actuator and engaging the brake.

To pressurize a line 107 communicated with input clutch actuator 43 at the Reel-In position of lever 16 while venting that actuator to tank at all other positions of the lever, bore 66 has still another groove 108 communicated with line 107 and situated between the previously described fluid supply groove 72 and drain groove 106. Spool 67 has an additional land 109 positioned to block groove 108 from the supply groove 72 while communicating groove 108 with drain groove 106 at the Brake-On position of spool 67 and also at the Brake-Off and Free-Spool positions which are realized by rightward movement of spool 67 from the Brake-On position as viewed in FIG. 3. When the control spool 67 is shifted leftwardly to the Reel-In position, land 109 blocks groove 108 from the drain groove 106 and then communicates groove 108 with inlet groove 72 to pressurize the input clutch line 107.

The disconnect clutch pressurization line 111 is communicated with still another groove 112 of bore 66. Another land 113 of control spool 67 is positioned to block groove 112 from supply groove 72 while communicating groove 112 with an adjacent drain groove 114 at all positions of spool 67 other than the Free-Spool position which is realized by moving the spool to the extreme rightward position as viewed in FIG. 3. Accordingly, the disconnect clutch actuator is pressurized to release the winch drum for unresisted rotation only at the Free-Spool position of the control valve.

If the pump 73 which supplies pressurized fluid to the system should stop operating because of malfunction of the driving engine or for some other reason, the loss of pressure in the several actuator lines 99, 107 and 111 will automatically bring about the Brake-On condition at which the winch drum is immobilized. However, under this condition there may be circumstances at which the operator desires to controllably release cable from the winch to relieve the force of the load on the cable. To enable release of the brake for this purpose, another check valve 116 transmits fluid from pump 73 to an accumulator 117 which is communicated with still another groove 118 of bore 66. Two slots 119 are positioned 180° apart on spool land 94 so as not to communicate with passage 93 in reel-in position, but to transmit pressurized fluid from the accumulator to groove 101 via slots 103 to groove 98 only when the spool 67 is shifted fully to the right, as seen in FIG. 3, to the Free-Spool position. This does not interfere with operation of the system when pump 73 is delivering pressurized fluid since groove 101 is already pressurized at the Free-Spool position by other means as described above. Although the control valve is shifted to the Free-Spool position for the above-described special purpose, it should be observed that a true Free-Spool mode of operation does not result in the absence of system pressure since the disconnect clutch line 111 cannot be pressurized under that circumstance.

Figure 4:
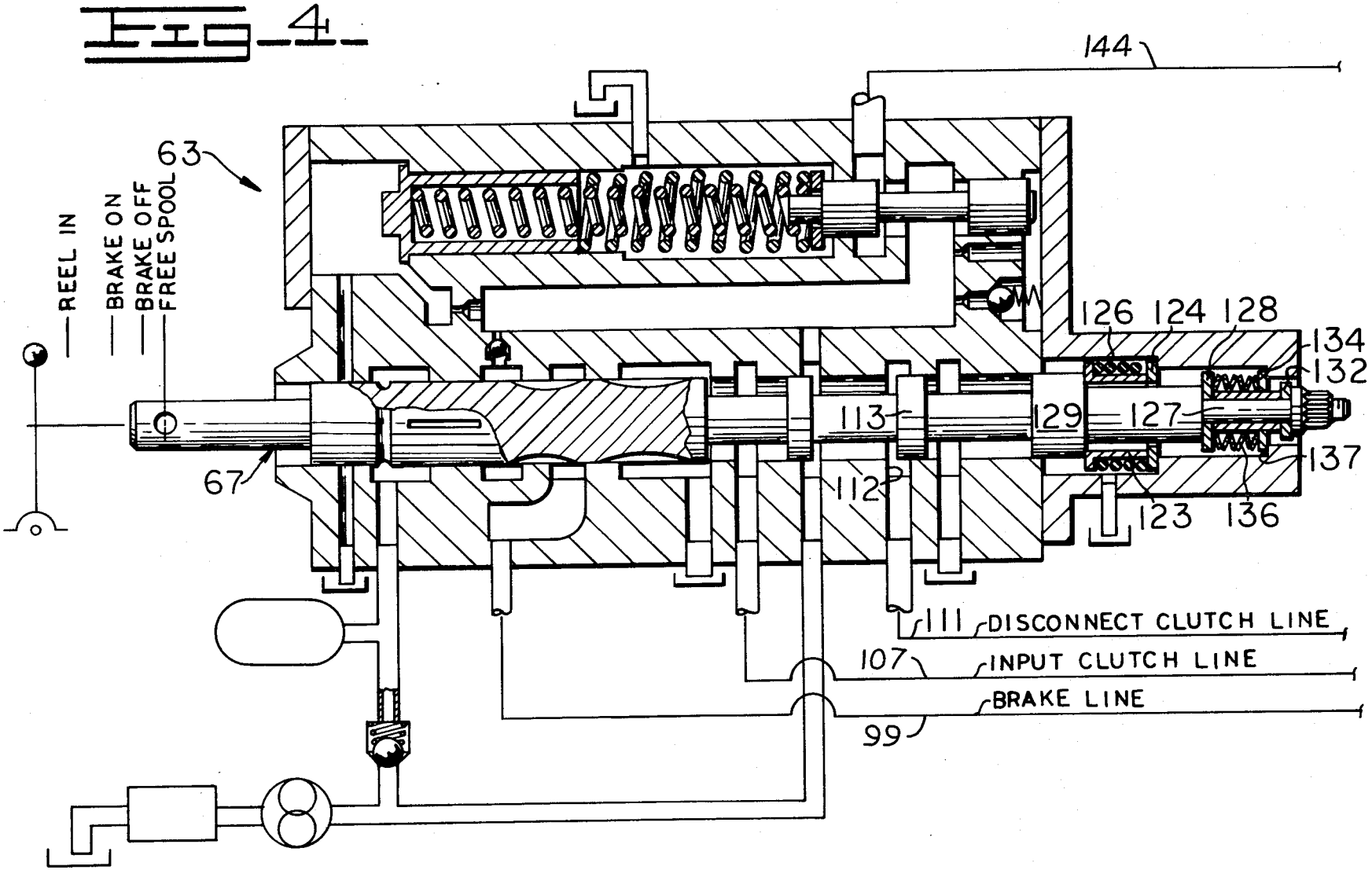
FIG. 4 illustrates in sectional view the control valve of FIG. 3 after shifting to a Free-Spool position at which there is no significant resistance to turning of the winch drum and at which cable may readily be withdrawn from the winch drum.

From the foregoing it may be seen that the clutch and brake pressurizations and de-pressurizations needed to effect the several described modes of which operation may be realized by simply shifting the operator's control lever 16 between the appropriate one of the four positions of the lever. In order to restore the valving element spool 67 and lever 16 to the Brake-On position automatically when the lever is released a centering spring assembly 121 is situated in a chamber 122 adjacent to the end of bore 66. Chamber 122 is of a larger diameter than the adjacent end of bore 66 and contains a sleeve 123 having a flange 123' at the end adjacent bore 66, the end of the spool 67 being extended through the sleeve in coaxial relationship therewith. Chamber 122 also contains an annular element 124 through which the end of spool 67 extends and a centering spring 126 which extends between the flange of sleeve 123 and the annular element 124 in coaxial relationship with the spool end. A sub-chamber 122' forms a lesser-diameter extension of chamber 122 and a bolt 127 extends axially from the end of spool 67 within sub-chamber 122' and has a washer 128 disposed coaxially thereon adjacent the end of the spool. Spring 126 urges a sleeve 123 and annular member 124 in opposite directions. Movement of sleeve 123 is limited by abutment of the flange 123' against one end of chamber 122 while movement of annular member 124 is limited by abutment against the other end of the same chamber. As annular 124 bears against washer 128 while sleeve flange 123' may exert a force against an adjacent land 129 of spool 67 the effect of the centering spring assembly is to continually urge the spool 67 towards the Brake-On position. If the spool 67 is shifted rightwardly as viewed in FIG. 3, land 129 acting through sleeve 123 tends to compress spring 126 while if the spool is shifted in the opposite direction, washer 128 acting through annular member 124 again tends to compress the spring. Spool travel is limited in either direction by abutment of sleeve 123 against annular member 124 as shown in FIG. 4.

Considering now the means which acts to produce an abrupt, kinesthetically detectable increase in the resistance to movement of spool 67 and control lever 16 as the Free-Spool position is approached, with reference again to FIG. 3, a sleeve 131 is disposed coaxially around bolt 127 and extends from washer 128 to another washer 132 which in turn abuts an enlarged head 133 on the end of the bolt. An annular element 134 is disposed coaxially on sleeve 131 adjacent washer 132 an a plurality of annular belleville springs 136 of conical section shape are disposed coaxially on sleeve 131 between washers 128 and 134 to resist movement of one washer towards the other with a resilient force. It will be apparent that other forms of spring may extend between the two washers 128 and 134 if desired.

Chamber extension 122' has an internal step 137 positioned to be contacted by annular element 134 upon movement of the valve spool 67 toward the Free-Spool position just prior to the time that position is reached. Accordingly, further movement of the valve spool 67 and control lever 16 into the Free-Spool position can only be accomplished by compressing the belleville springs 136 as illustrated in FIG. 4. This additional resistance to spool movement enables the operator to sense when the winch drum is about to be freed from any significant resistance against rotation so that he may terminate further control lever movement if he does not in fact desire to establish that condition.

Referring now once again to FIG. 2, there is illustrated therein normally disengaged auxiliary brake means 140 for stopping rotation of the winch drum 12 caused by viscous drag of hydraulic fluid on drive means 142, which drive means include the normally disengaged input clutch 39, the normally engaged brake 53 and the normally engaged disconnect cluch 23, along with the various gearing components previously discussed. Hydraulic lubricating fluid in which these components are usually at least partially immersed can cause a viscous drag on the drive means when the valving element formed by the spool 67 illustrated in FIG. 3 is in the Brake-On position due to limited slippage which may occur in a one-way disconnect roller clutch 143 in accordance with the present invention. A detailed description of the operation of an appropriate auxiliary brake means 140 is found in co-pending application Ser. No. 751,564, entitled "WINCH VALVE DRAG BRAKE CONTROL", filed concurrently herewith of Richard F. Hoehn, Norman R. Allen and Ronald E. Wineburner, commonly assigned herewith. The description of said auxiliary brake means 140 and its mode of operation as described in said co-pending application are hereby incorporated herein by reference thereto.

When hydraulic fluid is supplied to activate the auxiliary brake means 140 as via a conduit 144 which directs hydraulic fluid to a chamber 146, a ring piston 148 is forced into contact with a ring plate 150 attached to the gear 57. The contact between the ring piston 148 and the ring plate 150 causes a braking force to be applied to the gear 57 thus braking the gear 58 the gear 46, the gear 47, the gear 51, the gear 52 and the winch drum 12. It is clear that the auxiliary brake means 140 thus acts against the drive means intermediate the brake 53 and the disconnect clutch 23.

Fluid flow directing means 152 illustrated most clearly in FIG. 5 and 6 and shown schematically in FIG. 2 is provided intermediate the winch lubricating means which include a discharge conduit 83 and lubricating line means, in the embodiment illustrated a pair of lubricating lines 154 and the auxiliary brake means 140. The fluid flow directing means 152 directs a flow of pressurized fluid from the winch lubricating means to the auxiliary brake means 140 responsive to shifting of the valving element means to the Brake-On position. The fluid flow directing means 152 also blocks said flow of pressurized fluid from the winch lubricating means to the auxiliary brake means 140 responsive to shifting of the spool 67 to each of the Brake-Off, Reel-In and Free-Spool position. Thus, the auxiliary brake means 140 is applied only in the Brake-On position and operates off of lubricating oil pressure from the discharge conduit 83.

Turning now primarily to FIGS. 5 and 6 it will be noted that pressure from the discharge conduit 83 enters a first passage 156 in the fluid flow directing means 152. Thence, the lubricating fluid flows via a second passage 158 in the fluid flow directing means 152 to a bore 160. Within the bore 160 there is a spool 162 an a slug 164. The spool 162 is biased by a spring 166 acting to force the spool 162 and the slug 164 towards a first end 168 of the bore 160. The slug 164 sits between the spool 162 and the first end 168 of the bore 160. Stop means, in the embodiment illustrated a post 170 prevents the slug 164 from travelling to the first end 168 of the bore 160. The spring 166 is generally in a second end 172 of the bore 160. In the mode illustrated in FIG. 6, the control valve 63 is in the Brake-On position. In this position, the spring 166 has forced the spool 162 and the slug 164 upwardly against the post 170. Fluid is introduced to the bore 160 via the second passage 158. The spool 162 includes an undercut 173 thereon which in the Brake-On mode communicates the second passage 158 in the fluid flow directing means 152 with a third passage 174 of the fluid flow directing means 152, which third passage 174 communicates via the conduit 144 with the auxiliary brake means 140 and operates in a manner previously explained. The fluid flow directing means 152 further includes a fourth passage 176 through which fluid from the first passage 156 is led off to lubricate the winch 12 via the pair of lubricating lines 154. It will be noted that communication is thus always retained between the first passage 156 and the fourth passage 176 and thus between the discharge conduit 83 and the pair of lubricating lines 154.

When the control valve 63 is shifted to the Reel-In position hydraulic pressure is directed via the line 107 to the input clutch 39 and via the line 99 to the brake 53. Thus, the input clutch 39 is thereby engaged and the brake 53 is thereby disengaged. Because of the presence of the one-way clutch 143 it is not necessary to precisely sequence this operation and indeed it is not absolutely necessary to pressurize the brake 53. The pressure being applied to the input clutch 39 is likewise applied via a fifth passage 178 in the fluid flow directing means 152 to an annulus 180 about the post 170. The fluid pressure in the annulus 180 then acts against the slug 164 forcing it against the spool 162 thus forcing the biasing of the spring 166 to be overcome whereby the spool 162 is propelled towards the second end 172 of the bore 160 sufficiently to cut off communication of the second passage 158 with the third passage 174 whereby lubricating fluid pressure is not applied to the auxiliary brake means 140. In particular operation, the land 182 upon the spool 162 cuts off the second passage 158 at the bore 160. Meanwhile, the third passage 174 communicates via the undercut 173 in the spool 162 and the bore 160 with a drain passage 184 in the fluid flow directing means 152 whereby pressure in the chamber 146 of the auxiliary brake means 140 is connected to drain via the conduit 144, the third passage 174, the undercut 173 and the drain passage 184. It should be noted that in the Reel-In position fluid pressure is not supplied via the brake line 99 but is instead drained in control valve 63.

When the control valve 63 is placed in the Brake-Off position or in the Free-Spool position, pressure is applied to the brake 53 via the brake line 99 and thence to about the second undercut 188 in the spool 162. This leads to the spool 162 being forced against the biasing of the spring 166 sufficiently to cut off incoming flow from the second passage 158 and to connect the chamber 146 of the auxiliary brake means 140 to drain via the drain passage 184. The pressure about the second undercut 188 in the spool 162 is also applied to the slug 164 to hold it upwards against the post 170 and prevent communication of pressurized fluid from the undercut 188 to the annulus 180. Whenever the control valve 63 is returned to the Brake-On position from any of the Reel-In, Brake-Off, or Free-Spool positions, the auxiliary brake means 140 is reapplied. Whenever there is no pressure in the annulus 180 or about the second undercut 188 in the spool 162 the spring 166 moves the spool 162 and the slug 164 upward against the post 170. Lubrication oil pressure is then again routed around the spool 162 as previously via the first passage 156, the second passage 158 and the third passage 174 to the conduit 144 and thence to the auxiliary brake means 140.

Figure 7:
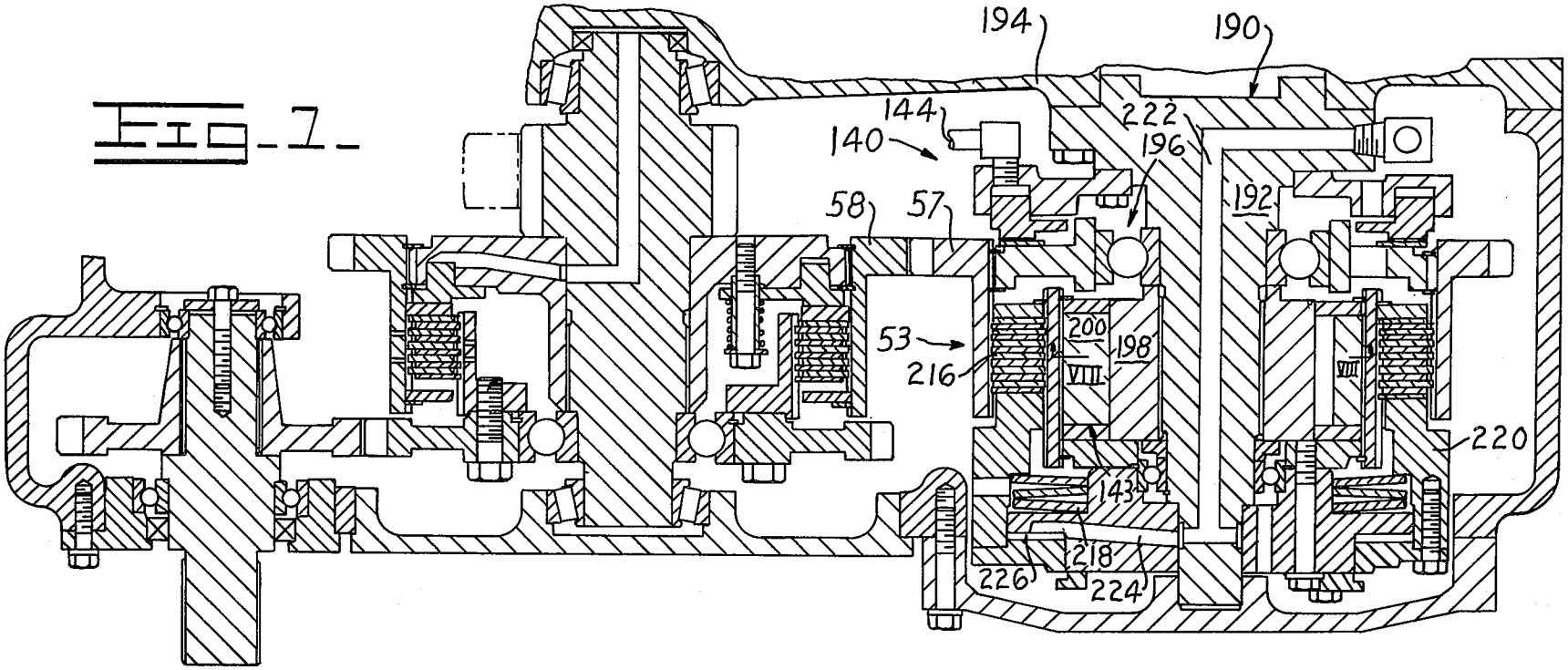
FIG. 7 illustrates in side elevational view a brake having a one-way clutch in accordance with the present invention.
Figure 8:
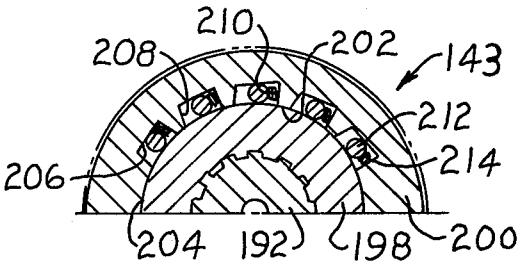
FIG. 8 illustrates in a one-half sectional view, a view taken along the line VIII—VIII of FIG. 7 and showing in detail a one-way clutch useful in the practice of the present invention.

Adverting now most particularly to FIGS. 7 and 8, there is illustrated therein not only the structure of the preferred auxiliary brake means 140 but most particularly the structure of the preferred one-way clutch 143 and its mode of operation. The one-way clutch 143 is positioned intermediate the normally engaged brake 53 and stationary support means therefor 190. The particular stationary support means 190, useful in the present invention, comprises a central stationary shaft 192 internally fixed to a casing 194 which also encloses other components of the drive train. The gear 57 is rotatably supported on the shaft 192 (54 in FIG. 2) via a ball bearing assembly 196 (56 in FIG. 2). The normally engaged brake 53 serves to brake the gear 57 via frictional engagement in a usual manner. A collar 198 is generally attached to the shaft 192 and is stationary as is the shaft 192. The collar 198 generally serves for spacing purposes. Intermediate the brake 53 and the stationary support means 190, the one-way clutch 143 is so arranged as to allow substantially unrestricted rotation of the drive means relative to the stationary support means 190 in a Reel-In direction and to normally prevent rotation of the drive means relative to the stationary support means 190 in a Reel-Out direction.

Thus, if one refers most particularly to FIG. 8, it is clear that the one-way clutch means 143 comprises a rotatable collar 200 which fits readily about the shaft 192 and more particularly about the collar 198 thereon, with a cylindrical inner surface 202 of the collar 200 in tolerance fit about a cylindrical surface 204 of the collar 198 as supported by the shaft 192. The rotatable collar 200 has a plurality of grooves 206 which extend thereinto from the inner surface 202 thereof, the grooves being generally parallel to the shaft 192. Each groove 206 is tapered so that a respective one of a plurality of rollers 212 are in a deep side 210 in the reel-in direction and in a shallow side 208 in the reel-out direction. Each groove 206 has therewithin one of the rollers 212 which extends longitudinally therealong. Each roller 212 has a diameter intermediate the depth of the side 208 and the depth of the side 210. Each groove has a biasing means, in the embodiment illustrated a spring 214 which biases the roller 212 away from the more deep side 210 of the respective groove 206.

As is clear by reference to FIG. 7, the normally engaged brake 53 comprises brake plate means 216 (59 in FIG. 2) which are supported by the rotatable collar 200. As is also clear from the FIG. 7, the normally engaged brake 53 is normally engaged under the impetus of spring means, namely a plurality of belleville washers 218. The normally engaged brake 53 is normally disengaged on application of pressure to oppose the force of the belleville washers 218 in a manner which will be described in following.

The brake disengaging means of the present invention preferably includes piston means or more particularly hollow piston means 220 (62 in FIG. 2) which fits about the shaft 192 coaxially therewith. The piston means 220 communicate with the brake plate means 216 and indeed bear against that brake means 216 in a manner which allows the brake plate means 216 to be forced into contact with corresponding plates (61 in FIG. 2) proceeding from the gear 57 thus causing a braking of the gear 57. Means are provided for selectively disengaging the normally engaged brake 53 to allow substantially unrestricted rotation of the drive means in the Reel-Out direction. The selective disengaging means in the embodiment illustrated comprises means for applying downward pressure to the piston 220 to oppose the force of the Belleville washers 218. Briefly, a passage 222 is provided through the shaft 192, which passage 222 leads to a cross passage 224. The cross passage 224 leads to a chamber 226 which when pressurized causes the piston 220 to move downwardly against the force of the belleville washers 218 thus causing the brake plate means 216 to be disengaged from corresponding plates proceeding from the gear 57. Thus, by proper movement of the spool 67, pressure can be applied to the chamber 226 thus selectively disengaging the normally engaged brake 53. When this is done, it is clear substantially unrestricted rotation of the drive means in the Reel-Out direction is provided.

While the invention has been described in connection with specific embodiments thereof, it will be understood that it is capable of further modification, and this application is intended to cover any variations, uses or adaptations of the invention following, in general, the principles of the invention and including such departures from the present disclosures as come within known or customary practice in the art to which the invention pertains and as may be applied to the essential features hereinbefore set forth, and as fall within the scope of the invention and the limits of the appended claims.

What is claimed is:

1. A winch and fluid control system which comprises (1) a rotatable drum for receiving and releasing a cable, (2) drive means for supporting said drum and for selectively transmitting rotary drive thereto, said drive means having a brake for stopping rotation of said drive means relative to stationary support means, (3) a source of pressurized fluid, and (4) control valve means having inlet means communicating with said source of pressurized fluid and having an outlet system and valving element means shiftable between at least three positions including a Brake-On position, a Reel-In position at which said brake is off and said drive means is reeling in said cable and a Brake-Off position, an improvement comprising:

one-way clutch means intermediate said brake and said stationary support means always allowing substantially unrestricted rotation of said drive means relative to said stationary support means in a reel-in direction when said brake is on or off and normally preventing rotation of said drive means relative to said stationary support means in a reel-out direction whereby reeling in of said cable can occur whether said brake is on or off; and means intermediate said outlet system and said brake for selectively disengaging said brake to allow substantially unrestricted rotation of said drive means in said reel-out direction.

2. An improvement in a system as in claim 1, wherein said brake is normally engaged under the impetus of spring means and is disengaged on application of pressure to oppose the force of said spring means.

3. An improvement in a system as in claim 2, wherein said stationary support means comprises a stationary shaft and said one-way clutch means comprises a collar radially about said shaft with a cylindrical inner surface thereof in close tolerance fit about a cylindrical surface supported by said shaft, said collar having a plurality of grooves extending thereinto from said inner surface thereof, said grooves being generally parallel to said shaft, each groove being tapered to be less deep on a side thereof towards which said collar rotates in a reel-in direction and to be more deep on a side thereof towards which said collar rotates in a reel-out direction, each groove having therewithin a roller extending longitudinally therealong, said roller having a diameter intermediate the depth of said less deep and more deep sides of said groove, said groove having biasing means biasing said roller away from said more deep side thereof.

4. An improvement in a system as in claim 1, wherein said stationary support means comprise a stationary shaft and said one-way clutch means comprises a collar radially about said shaft with a cylindrical inner surface thereof in close tolerance fit about a cylindrical surface supported by said shaft, said collar including means for allowing unrestricted rotation thereof in a reel-in direction and means for preventing rotation thereof in a reel-out direction.

5. A winch and fluid control system which comprises (1) a rotatable drum for receiving and releasing a cable, (2) drive means for supporting said drum and for selectively transmitting rotary drive thereto, said drive means having a brake for stopping rotation of said drive means relative to said stationary support means, (3) a source of pressurized fluid, and (4) control valve means having inlet means communicating with said source of pressurized fluid and having an outlet system and valving element means shiftable between at least three positions including a Brake-On position, a Reel-In position and a Brake-Off position, an improvement comprising:

one-way clutch means intermediate said brake and stationary support means always allowing substantially unrestricted rotation of said drive means relative to said stationary support means in a reel-in direction and normally preventing rotation of said drive means relative to said stationary support means in a reel-out direction, said stationary support means comprising a stationary shaft and said one-way clutch means comprising a collar radially about said shaft with a cylindrical inner surface thereof in close tolerance fit about a cylindrical surface supported by said shaft, said collar having a plurality of grooves extending thereinto from said inner surface thereof, said grooves being generally parallel to said shaft, each groove being tapered to be less deep on a side thereof towards which said collar rotates in a reel-in direction and to be more deep on a side thereof towards which said collar rotates in a reel-out direction, each groove having therewithin a roller extending longitudinally therealong, said roller having a diameter intermediate the depth of said less deep and more deep sides of said groove, said groove having biasing means biasing said roller away from said more deep side thereof, said brake being normally engaged under the impetus of spring means and being disengaged on application of pressure to oppose the force of said spring means, said normally engaged brake comprising brake plate means supported by said collar; and means intermediate said outlet system and said brake for selectively disengaging said brake to allow substantially unrestricted rotation of said drive means in said reel-out direction.

6. An improvement in a system as in claim 5, wherein said brake disengaging means includes piston means about said shaft communicating with said brake plate means and means for applying fluid pressure to said piston means to oppose said spring means.

7. An improvement in a system as in claim 6, wherein said fluid pressure applying means comprises passage means in said shaft.

* * * * *